US005936355A

United States Patent [19]

Kim

[11] Patent Number: 5,936,355

[45] Date of Patent: Aug. 10, 1999

[54] METHOD FOR DRIVING A PLASMA DISPLAY TO ENHANCE BRIGHTNESS

[75] Inventor: Sang-Chul Kim, Suwon-si, Rep. of Korea

[73] Assignee: Samsung Display Devices Co., Ltd., Kyungki-do, Rep. of Korea

[21] Appl. No.: 08/713,081

[22] Filed: Sep. 12, 1996

[30] Foreign Application Priority Data

Sep. 12, 1995 [KR] Rep. of Korea ..... 95-29697

[51] Int. Cl.[6] ..... G09G 3/28

[52] U.S. Cl. ..... 315/169.4; 315/169.1; 345/68; 345/63; 345/60

[58] Field of Search ..... 315/169.1, 169.4; 345/68, 60, 63, 94, 89, 77

[56] References Cited

U.S. PATENT DOCUMENTS 4,091,309 5/1978 Strom ..... 345/68 X 5,231,382 7/1993 Tanaka ..... 340/771

FOREIGN PATENT DOCUMENTS

0488326A2 6/1992 European Pat. Off. .

0674303A2 9/1995 European Pat. Off. .

*Primary Examiner*—Arnold Kinkead

*Attorney, Agent, or Firm*—Christie, Parker & Hale, LLP

[57] ABSTRACT

A method for driving a plasma display having a plurality of cathodes and anodes arranged in a matrix structure and a plurality of discharge cells formed at intersecting portions of the cathodes and anodes. Each cathode is addressed and subsequently a sustaining pulse for a predetermined time during a sustaining period is applied to each cathode so that the sustaining period is increased. The method maintains a discharge-sustaining time by adding a predetermined sustaining pulse during a writing phase after addressing all cathodes, thereby enhancing the brightness of the discharge cell.

9 Claims, 6 Drawing Sheets

METHOD FOR DRIVING A PLASMA DISPLAY TO ENHANCE BRIGHTNESS

FIELD OF THE INVENTION

The present invention relates to a method for driving a plasma display, and more particularly, to a method for driving a plasma display wherein a sustaining pulse is applied to a plasma cell during a writing phase to enhance its brightness.

BACKGROUND OF THE INVENTION

In general, flat panel displays have been utilized in systems having small installation areas as compared with cathode ray tubes. Some of the more commonly used flat panel displays include plasma display panels, electroluminescence elements and vacuum fluorescent devices. Thin film transistor-liquid crystal displays are another type of flat panel device. These displays are well suited for small screen applications but impractical for screen sizes beyond 20".

A plasma display panel consists of an array of discrete cells. Each cell is formed with a gas such as neon (Ne), argon (Ar) or helium (He) and encapsulated in glass. The plasma is formed in the gas, which may be excited by either an AC or DC field.

A large-sized plasma display panel can be easily fabricated by thick film printing technologies. Such plasma display panels have remarkable display characteristics including self-luminescence, rapid driving speed for gas discharge and a wide viewing angle ideal for wall-hanging televisions used for high definition television (HDTV). Consequently, these plasma display panels have become very popular.

The plasma display has six operating regions along the current-voltage (I–V) curve.

1) Low Current Region

There is a seed electron due to internal energy such as a neutron in a discharge tube. The seed electron is moved to an anode when an external electric field is applied, thereby causing a low current.

The amount of current is proportional to the number of seed electrons.

2) Townsend Region

When the number of electrons in the low current region exceeds a threshold number, discharge occurs and ionization increases by geometrical progression. The ionization of the plasma occurs primarily by electron collision.

3) Subnormal Glow Region

As the electric field is increased, the velocity of the electrons will exceed the velocity of the ions because of the higher mobility of the electrons. This increases the ion-electron pairs formed by electron collision, resulting in a space charge being formed in the discharge tube. The space charge results in an internal electric field redistributed into the internal gas. In the case of the discharge tube, the electric field is concentrated in the vicinity of the cathode, resulting in an initial electric field V/d of the discharge tube, where d is a distance between electrodes. As a result, ionization is increased and dV/dI has a negative characteristic.

4) Normal Glow Region

As the ion-electron pairs increase during ionization, the space charge becomes completely formed and the terminal voltage of the discharge tube is at the minimum value. At this time, dV/dI equals zero, meaning that current increases without raising the terminal voltage. Actually, as we look at the lightening in this region, we can notice that the lightening region increases.

5) Abnormal Glow Region

The entire surface of the cathode enters a glow state in the normal glow region. To increase the current, the terminal voltage of the discharge tube should be raised. At this time, the slope dV/dI has a positive resistance, and the ionization efficiency decreases. The plasma display operates in the abnormal glow region.

6) Arc Region

Increased ionization results in proportional current flow heating of the cathode surface. This causes the cathode to become damaged by ion sputtering, thereby destroying the discharge tube.

In the plasma display panel, individual control of each discrete cell is provided through a matrix structure of anodes and cathodes, as shown in FIG. 1. A discrete cell or display element is positioned at each intersection formed by the cathode-anode array and sandwiched therebetween. In AC applications, the cathodes and anodes are covered with a dielectric material, and in DC applications the electrodes are exposed.

FIGS. 2A and 2B show a timing diagram of a refreshing circuit for driving a conventional plasma display device. Initially, scanning signals are sequentially applied to cathodes $K_1$ through $K_n$. For each cathode scanned, anode signals representative of the image to be displayed are applied as shown in FIG. 2A.

The disadvantage of this approach is that cathodes $K_1$ through $k_n$ cannot be scanned simultaneously. resulting in a discharge time defined by the difference between the time required to drive a single frame and the addressing time for scanning one cathode. Thus, in wide plasma display applications having a large number of cathodes the time required to drive a single frame increases resulting in a decreased discharge time. For example, with a VGA plasma display having a size of 640×480 with a frame time of 1/60 second, the discharge time of a cell is about 33 $\mu$s. This results in decreased display brightness and therefore has limited applications for wide view display devices such as televisions.

To improve the brightness of the plasma display panel, a discharge cell has been developed to maintain a discharge subsequent to being scanned. This is called a memory method. The waveform for driving a plasma display panel according to the memory method is shown in FIGS. 3A and 3B and FIG. 4. In this embodiment, a series of pulses is sequentially applied to each cathode through an addressing operation. The addressing operation is divided into a writing phase 1 to start the discharge operation, and a sustaining phase 2. A writing pulse is applied to the cathode currently being addressed during the writing phase and a sustaining pulse is applied to every cathode during the sustaining phase irrespective of which cathode is being addressed. The time between the writing pulse of two sequential cathodes is 6 $\mu$s T1, which is enough time to implement both the writing phase and the sustaining phase As described above, when the writing pulses are sequentially applied to the cathodes, a driving signal as shown in FIG. 3A is applied to the corresponding anodes in accordance with the image to be displayed. As a result, the selected cells discharge. After discharge an electric charge particle remains in the cells for a short period. If a low voltage is applied to those cells before the disappearance of the electric charge particle, the cells continuously discharge after the writing pulses are removed.

Conversely, when a discharge is not initiated in a cell because a driving signal is not applied to its corresponding anode, the sustaining pulse would not initiate a discharge in the cell because the sustaining pulse voltage applied to the cell is below the threshold voltage to initiate discharge. Accordingly, after completion of an addressing operation, if a cell is activated to perform a discharge-sustaining operation, the discharge-sustaining time of cell becomes 5.74 ms due to both T1=6 $\mu$s and T2=2.5 $\mu$s in a plasma display having 480 cathodes. That is, since the discharge-sustaining time increases, the cell experiences increased brightness.

A disadvantage of this approach is that the drive time for each cell is the same. Moreover, each cell can only be controlled in the on or off state, and therefore, the color tone and brightness cannot be varied. In other words, the brightness of the discharge cell cannot be controlled in various degrees and the various color tones cannot be displayed.

To obtain multistage brightness capability, one scan of a cathode, or field, is divided into a plurality of subfields, and then the addressing and sustaining operations are sequentially performed. A method for controlling the brightness of one cell will be described with reference to FIG. 5. In this case, sixteen levels of brightness is achieved by dividing the cell into four subfields having sustaining phases equal to T×8, T×4, T×2, and T, respectively. A four-bit code is used, with the most significant bit (MSB) in the first subfield, the second MSB in the second subfield, the third MSB in the third subfield, and the least significant bit (LSB) in the fourth subfield. For example, if a four-bit code corresponding to a cell is 1011, the cell discharges in subfields one, three and four and maintains the discharging operation during sustaining phases T×8, T×4 and T×2, respectively. The discharging period of a cell according to various four-bit codes are shown in Table 1.

<TABLE 1>

| D3 | D2 | D1 | D0 | Discharging Period |
|---|---|---|---|---|
| 0 | 0 | 0 | 0 | 0 |
| 0 | 0 | 0 | 1 | T |
| 0 | 0 | 1 | 0 | 2T |
| 0 | 0 | 1 | 1 | 3T(T + 2T) |
| 0 | 1 | 0 | 0 | 4T |
| 0 | 1 | 0 | 1 | 5T(4T + T) |
| 0 | 1 | 1 | 0 | 6T(4T + 2T) |
| 0 | 1 | 1 | 1 | 7T(4T + 2T + T) |
| 1 | 0 | 0 | 0 | 8T |
| 1 | 0 | 0 | 1 | 9T(8T + T) |
| 1 | 0 | 1 | 0 | 10T(8T + 2T) |
| 1 | 0 | 1 | 1 | 11T(8T + 2T + T) |
| 1 | 1 | 0 | 0 | 12T(8T + 4T) |
| 1 | 1 | 0 | 1 | 13T(8T + 4T + T) |
| 1 | 1 | 1 | 0 | 14T(8T + 4T + 2T) |
| 1 | 1 | 1 | 1 | 15T(8T + 4T + 2T + T) |

With this approach, the discharge time of a cell is the difference between the field time and the addressing time of each corresponding cathode. Therefore, when the discharge time of a cell is controlled by a plurality of subfields, a new addressing time is required to each subfield, and the addressing time becomes longer in proportion to the number of subfields . As the addressing time becomes longer, a corresponding decrease in the discharge time of the cell is experienced, thereby lowering the brightness. In particular, in the case where increasing numbers of subfields are required in order to increase the number of brightness levels, more addressing period are required, resulting in the problem of reduced brightness.

SUMMARY OF THE INVENTION

It is therefore an object of the present invention to solve the above problem by providing a method for driving a plasma display which maintains a discharge-sustaining time by adding a predetermined sustaining pulse to a writing phase after addressing all cathodes, thereby enhancing a brightness of a discharge cell.

In order to achieve this object, in a plasma display having a plurality of cathodes and anodes of matrix structures and a discharge cell formed at an intersecting portion of a cathode and an anode, each cathode is addressed an addressing period and then a sustaining pulse is applied to each electrode for a predetermined time in a sustaining period following the addressing period.

DETAILED DESCRIPTION OF THE PREFERRED EMBODIMENTS

The preferred embodiments of the present invention will become apparent from a study of the following detailed description, when viewed in light of the accompanying drawings.

Figure 1:
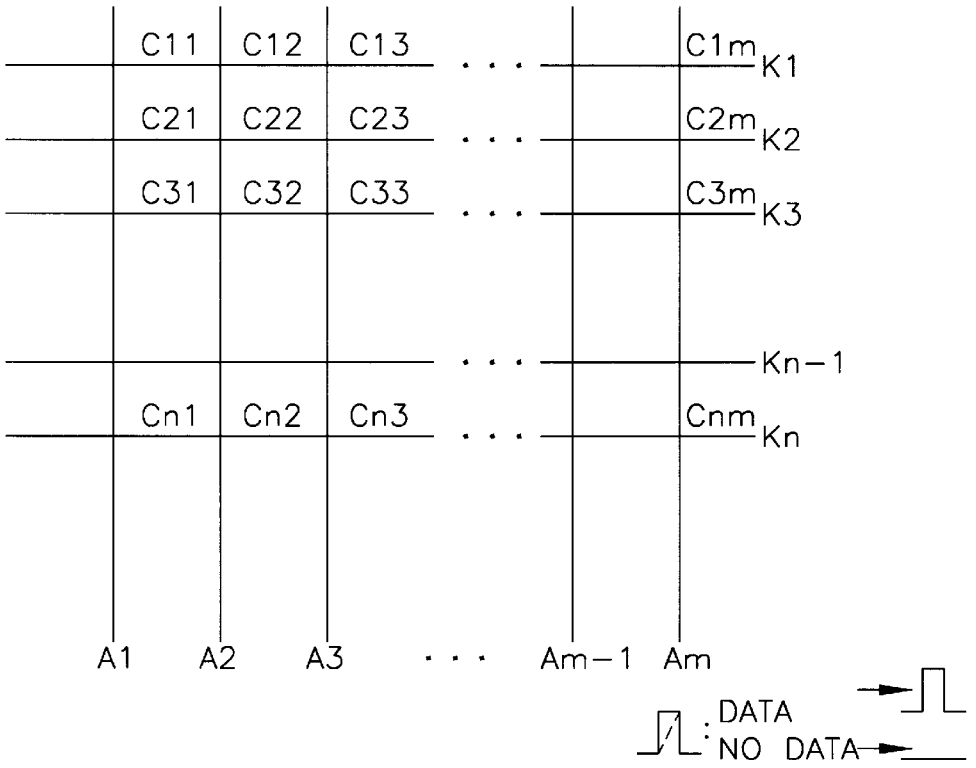
FIG. 1 (PRIOR ART)
FIG. 1 illustrates a systematic configuration of a general plasma display.
Figure 4:
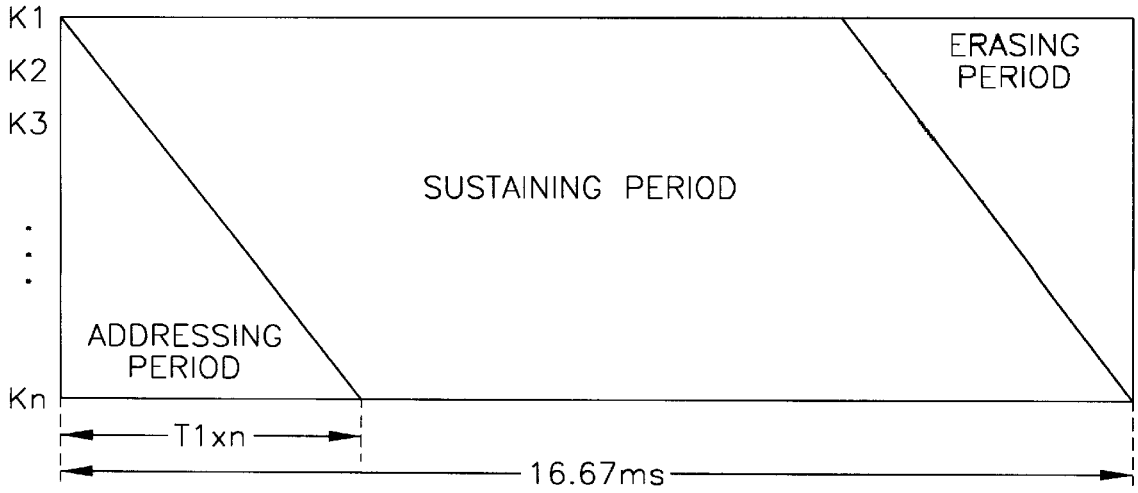
FIG. 4 (PRIOR ART)
FIG. 4 is a timing diagram for two gray control.
Figure 2A:
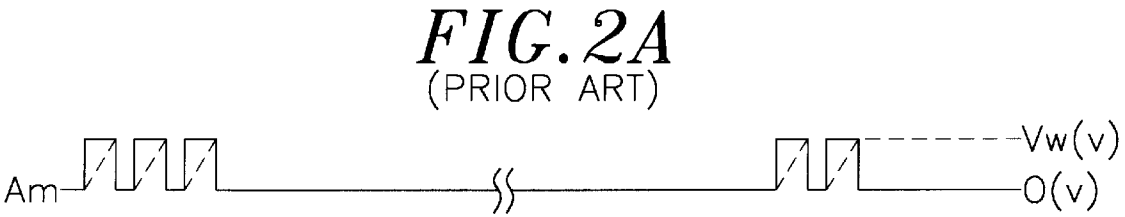
FIG. 2A (PRIOR ART)
FIGS. 2A and 2B show an operating waveform and a timing diagram of a conventional plasma display panel.
Figure 2B:
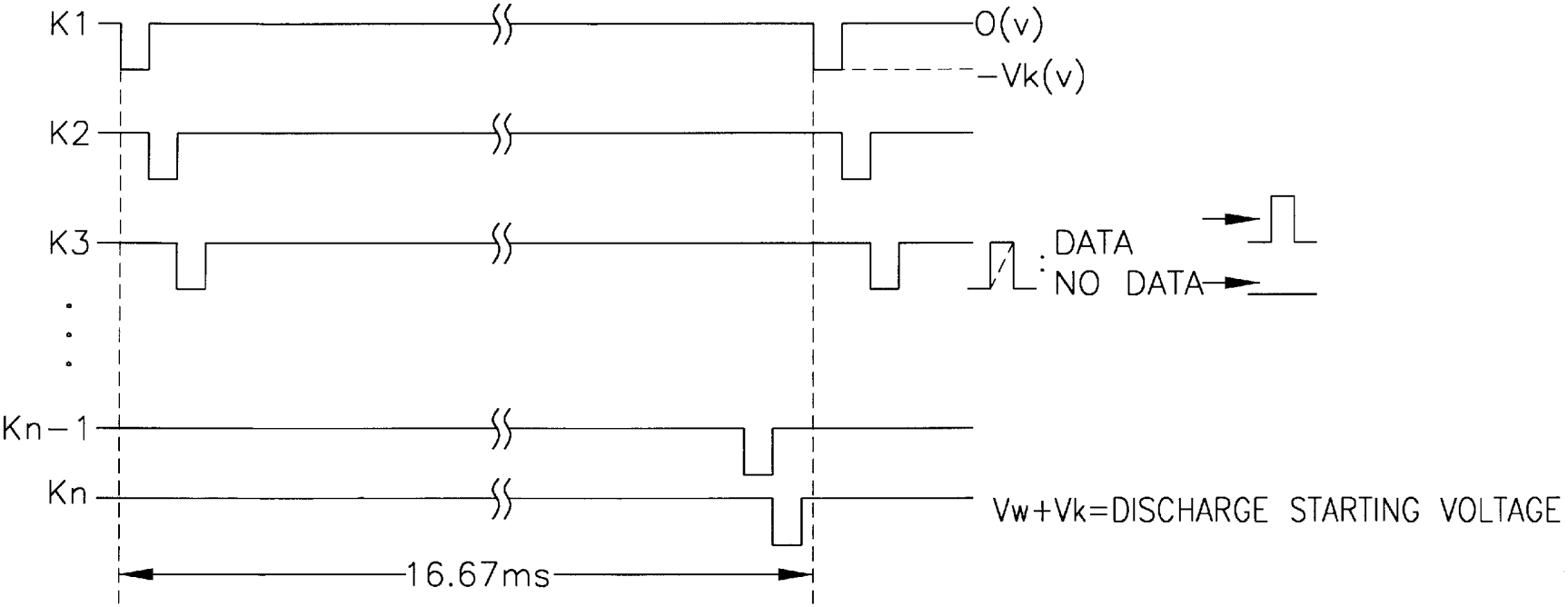
FIG. 2B (PRIOR ART)
Figures 3A, 3B:
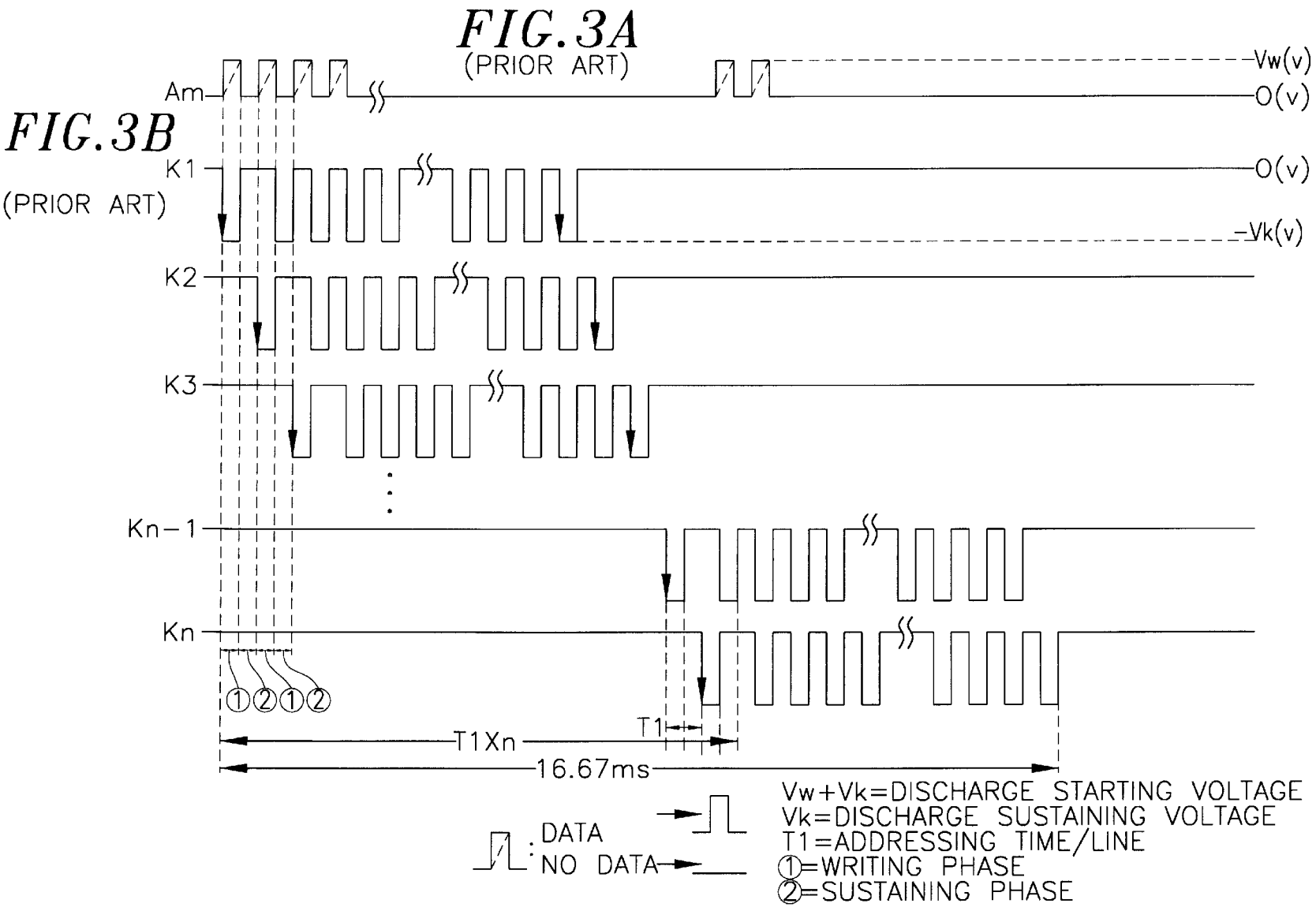
FIG. 3A (PRIOR ART)
FIG. 3B (PRIOR ART)
FIGS. 3A and 3B show an operating timing diagram of another conventional plasma display panel.
Figure 5:
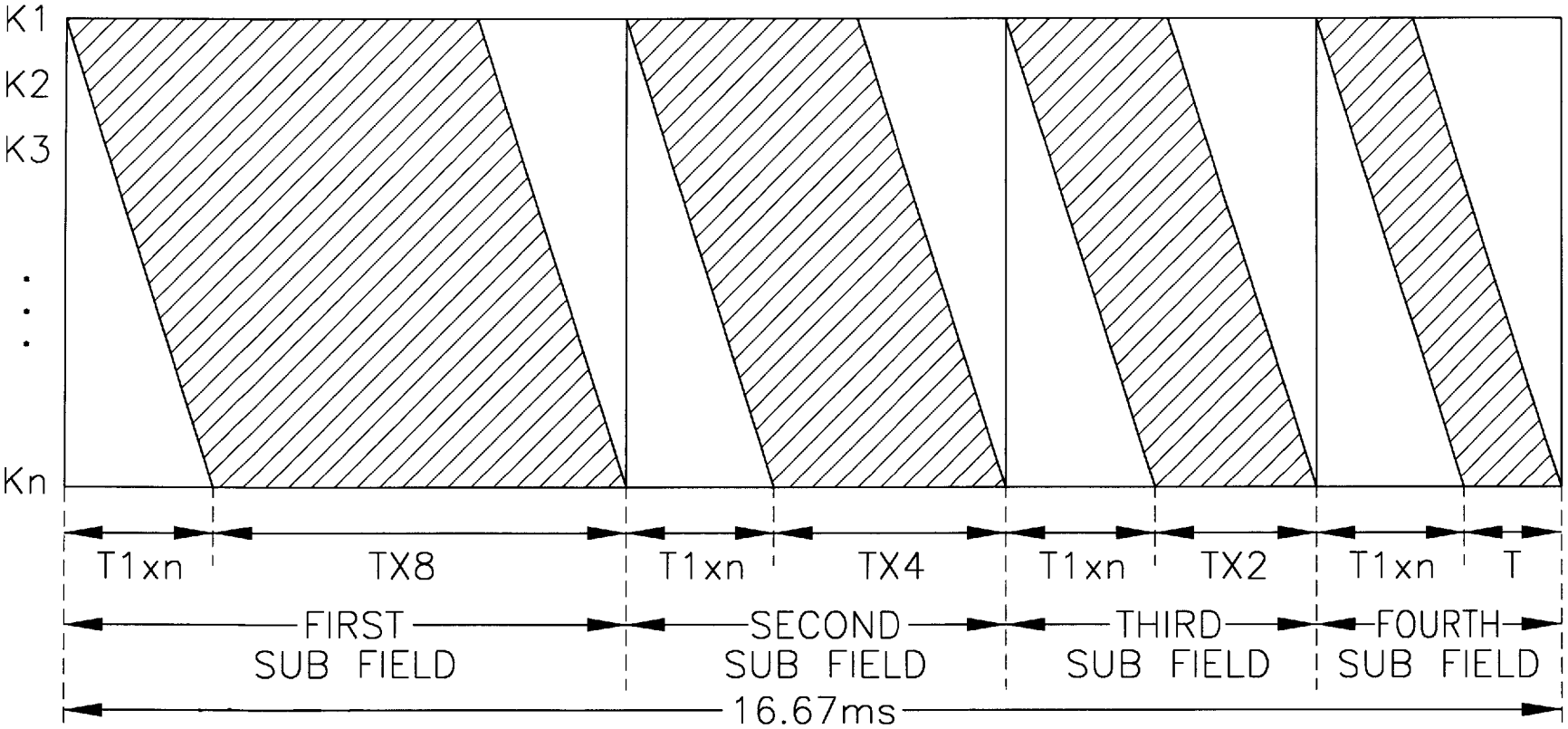
FIG. 5 (PRIOR ART)
FIG. 5 is a timing diagram for sixteen gray control.

As shown in FIG. 1, a plasma display has a plurality of cathodes $K_1$ through $K_n$ and a plurality of anodes $A_1$ through $A_m$ in a matrix structure. Cells $C_{11}$ through $C_{nm}$ are formed at intersecting portions of cathodes and anodes.

Figures 6A, 6B:
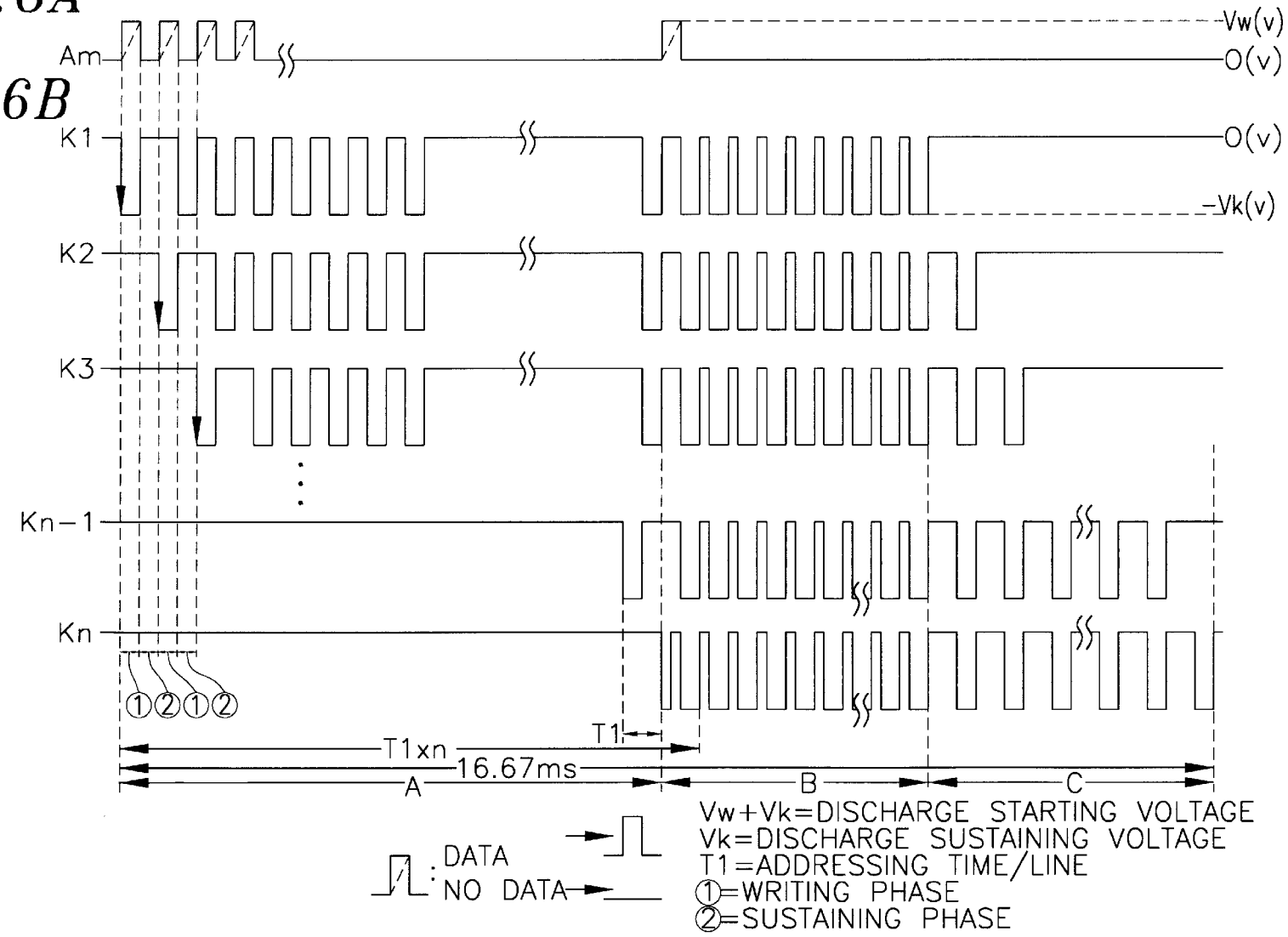
FIGS. 6A and 6B show an operating waveforn of a plasma display in accordance with a preferred embodiment of the present invention.

To discharge a discrete cell in the plasma display in this matrix structure, driving pulses of FIG. 6B are sequentially applied to the cathodes. Each series of pulses applied to a cathode during an addressing period comprises a write pulse which is applied in the writing phase, and a sustaining pulse applied in the sustaining phase.

In the addressing period, a pulse cannot be applied to more than one cathode during the writing phase. For example, cell $C_{11}$ is controlled by cathode $K_1$ and anode $A_1$. If a pulse is additionally applied to a second cathode $K_2$ during the writing phase of the first cathode $K_1$, the cell $C_{21}$ would be affected by the image signal for $C_{11}$ Therefore, an additional sustaining pulse cannot be applied to all cathodes during the writing period. However, on completion of the scanning operation of the cathodes, periodic sustaining pulses can be applied to each cathode. Specifically, during a period between an addressing time of the nth cathode $K_n$ and a disappearance time of the first cathode $K_1$, pulses are additionally applied to each cathode during the writing and sustaining phases.

In order to eliminate the brightness difference of each discharging cell, the discharge time of each cell must be equal. Thus, pulses are not applied at all to the cathodes during a period between the disappearance of the first cathode $K_1$ and of the nth cathode $K_n$. Therefore, when the anode signal representative of the image to be displayed is applied to the first anode $A_1$ during the addressing period of the first cathode, a corresponding cell $C_{11}$ of the matrix structure starts to discharge. Then, the discharge state is maintained by sustaining pulses during the sustaining phases in period A of FIG. 6. Once the scanning operation is complete, a sustaining pulse is applied to each cathode during the writing and sustaining phases as shown in B of FIG. 6. The sustaining pulses are removed during period C of FIG. 6 and, therefore, the discharging operation ceases.

Figure 7:
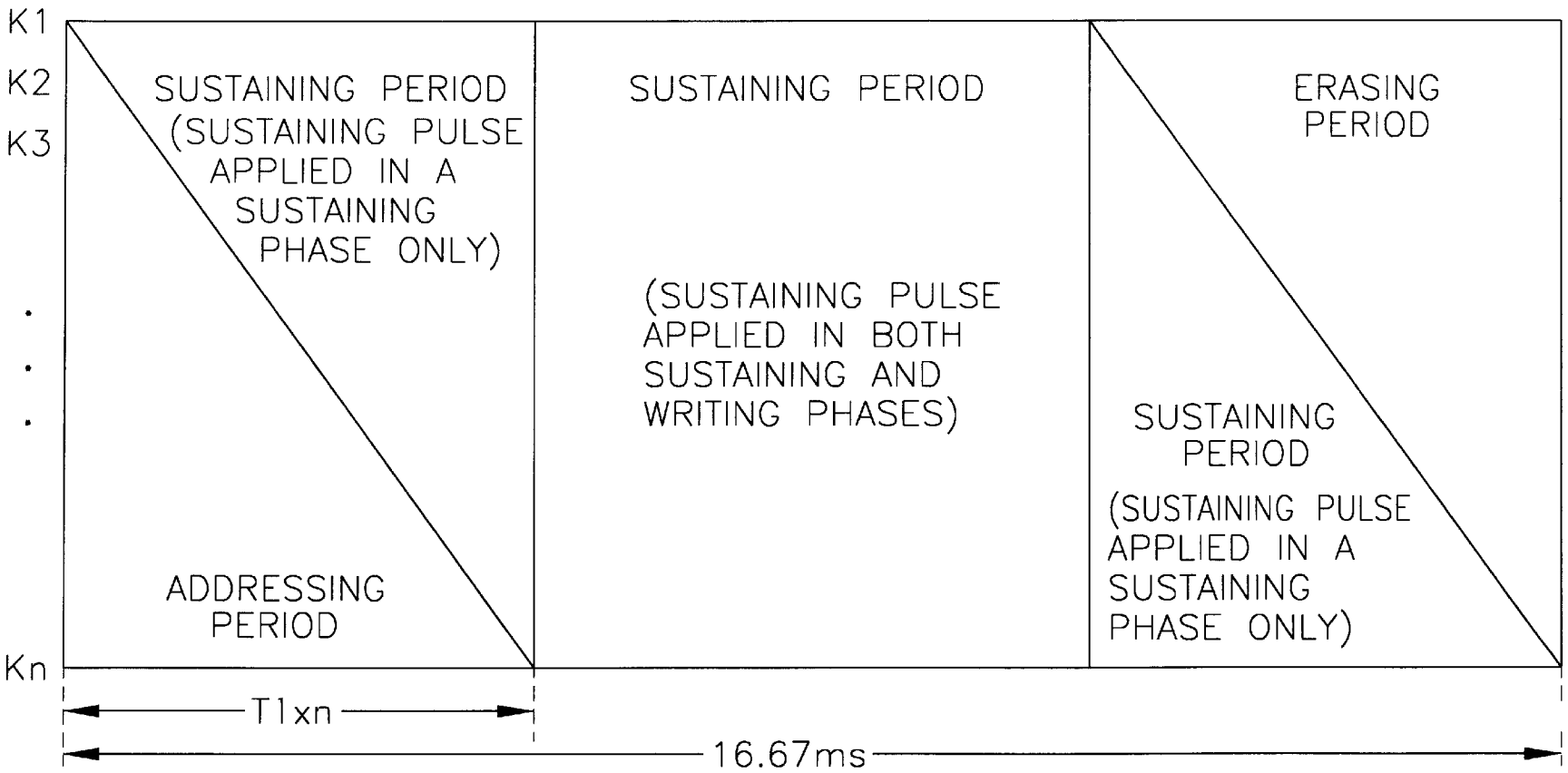
FIG. 7 is a timing diagram of a plasma display in accordance with a preferred embodiment of the present invention.

As shown in the driving timing chart shown in FIG. 7, during a period between an addressing time of the nth cathode $K_n$ and a disappearance time of the first cathode $K_1$, a discharge-sustaining operation is additionally generated by additional sustaining pulses. As a result, the discharge-sustaining period increases. In other words, in driving a plasma display with a memory driving system, after the addressing operation for scanning each cathode is complete, a sustaining pulse is additionally applied for a predetermined time during a sustaining period and thus the discharge-sustaining period is increased, which enhances the brightness of the discharge cell.

The disclosure of attached Korean patent application, serial no. 95-29697, filed on Sep. 12, 1995, is incorporated fully herein by reference. Priority of this Korean application is claimed.

What is claimed is:

1. A method for driving a plasma display having a plurality of cathodes and anodes arranged in a matrix structure, and a plurality of discharge cells formed at intersecting portions of the cathodes and the anodes, comprising the steps:

addressing each of the cathodes sequentially from a first cathode to an $n^{th}$ cathode in an addressing period, said $n^{th}$ cathode being the last cathode addressed;

applying a first sustaining pulse to a plurality of the cathodes in only a sustaining phase of a first sustaining period, said first sustaining period following the addressing period; and applying a sustaining pulse to all cathodes in both a writing phase and a sustaining phase of a second sustaining period, said second sustaining period beginning after completion of addressing the $n^{th}$ cathode and ending at the beginning of an erasing period of the first cathode.

2. A method for driving a plasma display having a plurality of cathodes and anodes arranged in a matrix structure, and a plurality of discharge cells formed on intersecting portions of the cathodes and the anodes, comprising the steps of:

addressing each of the cathodes during an addressing period, said addressing period comprising alternate writing and sustaining phases, wherein a writing pulse is applied to not more than one cathode in each of the writing phases; and sustaining each of the cathodes during a sustaining period, said sustaining period following the addressing period, and comprising alternate writing and sustaining phases, wherein a sustaining pulse is applied to each of the cathodes in each of the writing and sustaining phases of the sustaining period.

3. The method for driving a plasma display of claim 2 further comprising the step of initiating an erasing period following the sustaining period.

4. The method for driving a plasma display of claim 2 further comprising the step of applying a sustaining pulse to a plurality of the cathodes in a plurality of the sustaining phases before the sustaining period.

5. A method for driving a plasma display having a plurality of cathodes and anodes arranged in a matrix structure, and a plurality of discharge cells formed on intersecting portions of the cathodes and the anodes, comprising the steps of:

addressing each of the cathodes sequentially from a first cathode to an $n^{th}$ cathode, the addressing time for each of the cathodes comprising a writing phase and a sustaining phase;

applying a writing pulse to each of the cathodes in the writing phase of its respective addressing time;

applying a sustaining pulse to each of the cathodes in the sustaining phase of each of the addressing times following its respective addressing time; and applying a plurality of sustaining pulses to each of the cathodes for a predetermined time following the addressing time of the $n^{th}$ cathode, said plurality of sustaining pulses having a duty cycle greater than 50 percent.

6. The method for driving a plasma display of claim 5 wherein a period defined by two of said plurality of sustaining pulses is approximately equal to the addressing time of one of the cathodes.

7. The method for driving a plasma display of claim 5 further comprising the steps of erasing each of cathodes sequentially from the first cathode to the $n^{th}$ cathode beginning at the end of the predetermined time.

8. The method for driving a plasma display of claim 2 further comprising the step of applying a sustaining pulse to a plurality of cathodes during one of the sustaining phases after the writing pulse is applied to each of said plurality of electrodes and before the writing pulse is applied to all of the electrodes.

9. A method for driving a plasma display having a plurality of cathodes and anodes arranged in a matrix structure, and a plurality of discharge cells formed at intersecting portions of the cathodes and the anodes, comprising the steps:

addressing each of the cathodes sequentially from a first cathode to an $n^{th}$ cathode in a writing phase of an addressing period;

applying a sustaining pulse to a plurality of the cathodes in a sustaining phase of a first sustaining period after said plurality of electrodes have been addressed and before the addressing period for the $n^{th}$ cathode; and applying a sustaining pulse to each cathode in both a writing phase and a sustaining phase of a second sustaining period, said sustaining period beginning after completion of the addressing period of the $n^{th}$ cathode and ending at initiation of an erasing period of the first cathode.

* * * * *